US005402153A

United States Patent [19]

Agano

[11] Patent Number: 5,402,153

[45] Date of Patent: Mar. 28, 1995

[54] THERMAL RECORDING APPARATUS

[75] Inventor: Toshitaka Agano, Kanagawa, Japan

[73] Assignee: Fuji Photo Film Co., Ltd., Kanagawa, Japan

[21] Appl. No.: 40,093

[22] Filed: Mar. 30, 1993

[30] Foreign Application Priority Data

Mar. 30, 1992 [JP] Japan ..... 4-074027

[51] Int. Cl.[6] ..... B41J 2/435

[52] U.S. Cl. ..... 347/262; 355/205

[58] Field of Search ..... 346/1.1, 107 R, 76 L, 346/108, 136, 160, 134; 355/200, 202, 204, 205, 206, 309

[56] References Cited

U.S. PATENT DOCUMENTS 5,021,827 6/1991 Komiya et al. ..... 355/206

FOREIGN PATENT DOCUMENTS 50-23617 3/1975 Japan .
58-94494 6/1983 Japan .
61-291183 12/1986 Japan .
62-77983 4/1987 Japan .
62-78964 4/1987 Japan .
524219 2/1993 Japan .
5301447 11/1993 Japan .

*Primary Examiner*—Mark J. Reinhart
*Attorney, Agent, or Firm*—Sughrue, Mion, Zinn, Macpeak & Seas

[57] ABSTRACT

A thermal recording apparatus capable of preventing in advance a thermo-sensitive recording medium or the apparatus from being excessively heated when the apparatus is defective in operation. When a failure in operation of a polygon mirror is detected by a scanning sensor, when a failure in operation of a motor is detected by an encoder or when jamming or the like of a thermo-sensitive recording medium S is detected by a pair of feed sensors, a controller outputs a malfunction signal to a solenoid. The solenoid, activated at all times, is deactivated by the malfunction signal thereby to cause the shielding plate to cut off a laser beam L. Thus, even if a failure in operation of the thermal recording apparatus is developed, the thermo-sensitive recording medium S and the thermal recording apparatus can be prevented from being excessively heated with the laser beam L.

2 Claims, 4 Drawing Sheets

THERMAL RECORDING APPARATUS

BACKGROUND OF THE INVENTION

1. Field of the invention

This invention relates to a thermal recording apparatus for recording image information on a thermo-sensitive recording medium with a laser beam irradiated thereto, and more specifically to a thermal recording apparatus provided with means for avoiding in advance inconveniences developed in a thermo-sensitive recording medium or the apparatus owing to an abnormality in the operation of the apparatus.

2. Description of the Related Art

A thermal recording apparatus for recording image information on a thermo-sensitive recording medium by applying heat energy thereto has been widespread. In particular, an apparatus of this type, provided with a laser beam as the heat source and capable of recording an image at a high speed, has been proposed (see Japanese Laid-Open Patent Publication Nos. 50-23617, 58-94494, 62-77983 and 62-78964, for example).

The present applicant has developed and applied for a patent a thermo-sensitive recording medium applicable to such a thermal recording apparatus and capable of recording high quality images thereon, which comprises leuco dyes, a developer and light-absorbing dyes, all provided on a support member, and develops color at a density responsive to the heat energy applied thereto (see Japanese Patent Application No. 3-62684 and Japanese Laid-Open Patent Publication No. 5-24219).

The thermo-sensitive recording medium comprises a thermo-sensitive layer formed on a support member by applying thereto a coating liquid containing a developer and light-absorbing dyes, together with microcapsules containing at least leuco dye, dissolved in an organic solvent insoluble or hardly soluble in water, and thereafter dispersed and emulsified in an aqueous medium.

The leuco dyes have the property of donating electrons, or accepting protons from acid, in developing color. The leuco dyes are normally substantially colorless and have partial skeletons such as lactone, lactam, sultone, spiropyran, ester, amide, etc. which allow to open rings or produce cleavages when held in contact with the developer. Specific examples of the leuco dyes may include crystal violet lactone, benzoyl leucomethylene blue, malachite green lactone, rhodamine B lactam, 1,3,3-trimethyl-6′-ethyl-8′-butoxyindolinobenzo spiropyran, etc.

Acidic substances such as phenolic compounds, organic acids or metallic salt containing the same, oxybenzoate ester, etc. are used as developers corresponding to these leuco dyes. The developers may preferably have a melting point ranging from 50° C. to 250° C. Particularly preferred is phenol or an organic acid insoluble in water, having a melting point ranging from 60° C. to 200° C. Specific examples of the developers have been described in Japanese Laid-Open Patent Publication No. 61-291183, for example.

Preferred as the light-absorbing dyes are those which absorb less light in the visible-light wavelength region and exhibit particularly a high absorption rate for radiation in the infrared wavelength region. Examples of the light-absorbing dyes may include cyanine dyes, phthalocyanine dyes, pyrylium and thiopyrylium dyes, azulenium dyes, squarylium dyes, metal complex dyes containing Ni, Cr, etc., naphthoquinone and anthraquinone dyes, indophenol dyes, indoaniline dyes, triphenyl- methane dyes, triallylmethane dyes, ammonium and diammonium dyes, nitroso compounds, etc. Of these, it is preferable to use those having a high absorption rate for light of a wavelength ranging from 700 nm to 900 nm in the near infrared region, on account of that a semiconductor laser for near infrared light has been put to practical use.

SUMMARY OF THE INVENTION

In the aforementioned thermal recording apparatus where the heat energy to the thermo-sensitive recording medium is given by the laser beam, a certain spot on the thermo-sensitive recording medium can be kept on irradiated with the laser beam over a period of time due to an abnormality in the operation. This tends to cause excessive heating in the thermo-sensitive recording medium or the thermal recording apparatus per se.

With this problem in view, it is an object of the present invention to provide a thermal recording apparatus capable of preventing in advance a thermo-sensitive recording medium or the apparatus per se from being excessively heated even when the operation of the thermal recording apparatus is in the abnormality.

According to one aspect of the present invention, for achieving the above object, there is provided a thermal recording apparatus for recording an image on a thermo-sensitive recording medium with a laser beam irradiated so as to apply predetermined heat energy thereto, moving the laser beam in a direction so as to effect main scanning, moving said thermo-sensitive recording medium in a direction substantially perpendicular to a main scanning direction so as to effect auxiliary scanning, said thermal recording apparatus comprising: main-scanned state detecting means for detecting the state of the main scanning effected on said laser beam; auxiliary-scanned state detecting means for detecting the state of the auxiliary scanning effected on the thermo-sensitive recording medium for feeding the same; determining means for determining an abnormality in the operation of the thermal recording apparatus based on detection signals produced by the main-scanned state detecting means and auxiliary-scanned state detecting means; and blocking means for preventing the thermo-sensitive recording medium from being kept irradiated with the laser beam when the operation of the thermal recording apparatus is determined as being in the abnormality.

In the thermal recording apparatus according to the present invention, the thermo-sensitive recording medium is moved in the auxiliary scanning direction and irradiated with the laser beam moving in the main scanning direction substantially normal to the auxiliary scanning direction, so as to apply the heat energy to the thermo-sensitive recording medium, thereby effecting a thermo-sensitive recording process. The scanned states on the main scanning and auxiliary scanning are respectively detected by the main-scanned state detecting means and the auxiliary-scanned state detecting means, and delivered to the determining means as the detection signals. It is then determined whether the apparatus is operated properly or improperly based on the detection signals. If it is determined that the operation of the apparatus is in an abnormal state, then the blocking means is activated so as to avoid the thermo-sensitive recording medium from being kept irradiated with the laser beam. Accordingly, the thermo-sensitive recording medium and the thermal recording apparatus per se can be prevented in advance from being excessively heated.

The above and other objects, features and advantages of the present invention will become apparent from the following description and the appended claims, taken in conjunction with the accompanying drawings in which a preferred embodiment of the present invention is shown by way of illustrative example.

DESCRIPTION OF THE PREFERRED EMBODIMENTS

A thermal recording apparatus according to the present invention will hereinafter be described in detail with reference to the accompanying drawings in which a preferred embodiment is shown by way of illustrative example.

Figure 1:
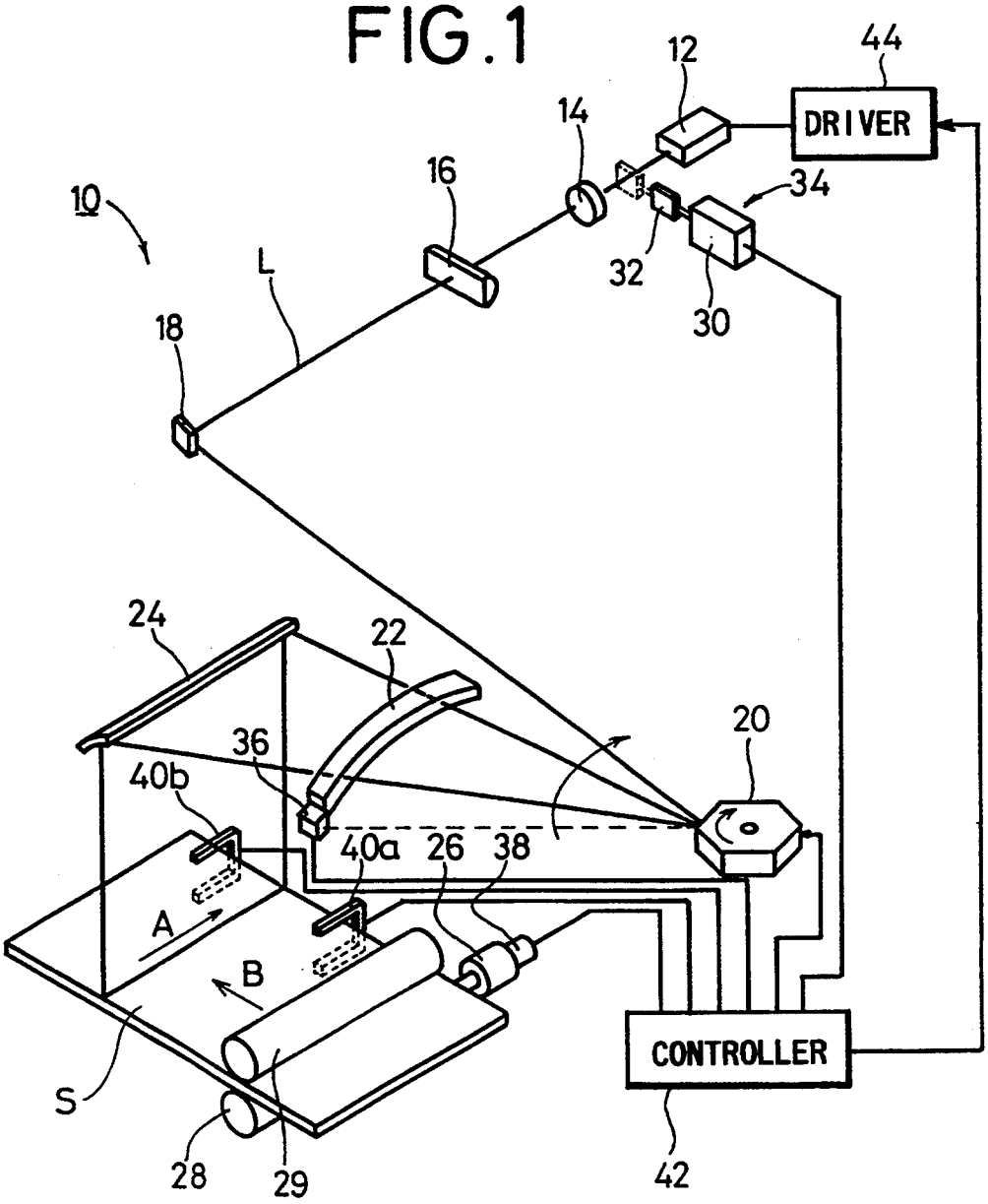
FIG. 1 is a perspective view showing the structure of a thermal recording apparatus according to the present invention.

Referring to FIG. 1, reference numeral 10 indicates a thermal recording apparatus. The thermal recording apparatus 10 records a scanned image on a thermo-sensitive recording medium S with a laser beam L main-scanned in the direction indicated by the arrow A, while the thermo-sensitive recording medium S is moved for auxiliary scanning in the direction indicated by the arrow B. The thermal recording apparatus 10 comprises a laser diode 12 for producing the laser beam L, a collimator lens 14 for making the laser beam L parallel as a bundle of light rays, a cylindrical lens 16, a reflection mirror 18, a polygon mirror 20 for deflecting the laser beam L, an f$\theta$ lens 22, a cylindrical mirror 24 for correcting a plane inclination of the polygon mirror 20 in cooperation with the cylindrical lens 16, and a feed roller 28 and a nip roller 29 both rotated by a motor 26 in order to feed the thermo-sensitive medium S for the auxiliary scanning in the direction indicated by the arrow B. Further, a blocking means 34 is provided for blocking the optical path of the laser beam L with a shielding plate 32 which can be displaced into the optical path of the laser beam L when a solenoid 30 is deactivated. A scanning sensor 36 for detecting a state of main scanning is provided at an end of the f8 lens 22. The scanning sensor 36 generates, each time the laser beam L passes through the scanning sensor 36, a detection signal indicative of a scanning speed of the laser beam L in the main scanning direction (i.e., in the direction indicated by the arrow A) or a rotational speed of the polygon mirror 20. An encoder 38 for detecting an auxiliary-scanned state is mounted to the motor 26. The encoder 38 detects a feed failure by counting the number of rotations of the motor 26. A pair of feed sensors 40*a* and 40*b*, which are spaced a predetermined interval away from each other, are provided on a feeding path of the thermo-sensitive medium S along the auxiliary scanning direction (i.e., in the direction indicated by the arrow B). The feed sensors 40*a* and 40*b* detect a state of the auxiliary-scanning representative of a feed speed of the thermo-sensitive recording medium S, a bent state or jamming of the thermo-sensitive recording medium S, etc. by measuring a time interval from the time when the thermo-sensitive recording medium S has been detected by one feed sensor 40*a* to the time when the thermo-sensitive recording medium S has been detected by the other feed sensor 40*b*. A controller 42 to which the blocking means 34, the scanning sensor 36, the encoder 38, the feed sensors 40*a* and 40*b* are electrically connected, activates a driver 44 so as to control the laser diode 12 and controls the rotational speed of each of the polygon mirror 20 and the motor 26.

Figure 2:
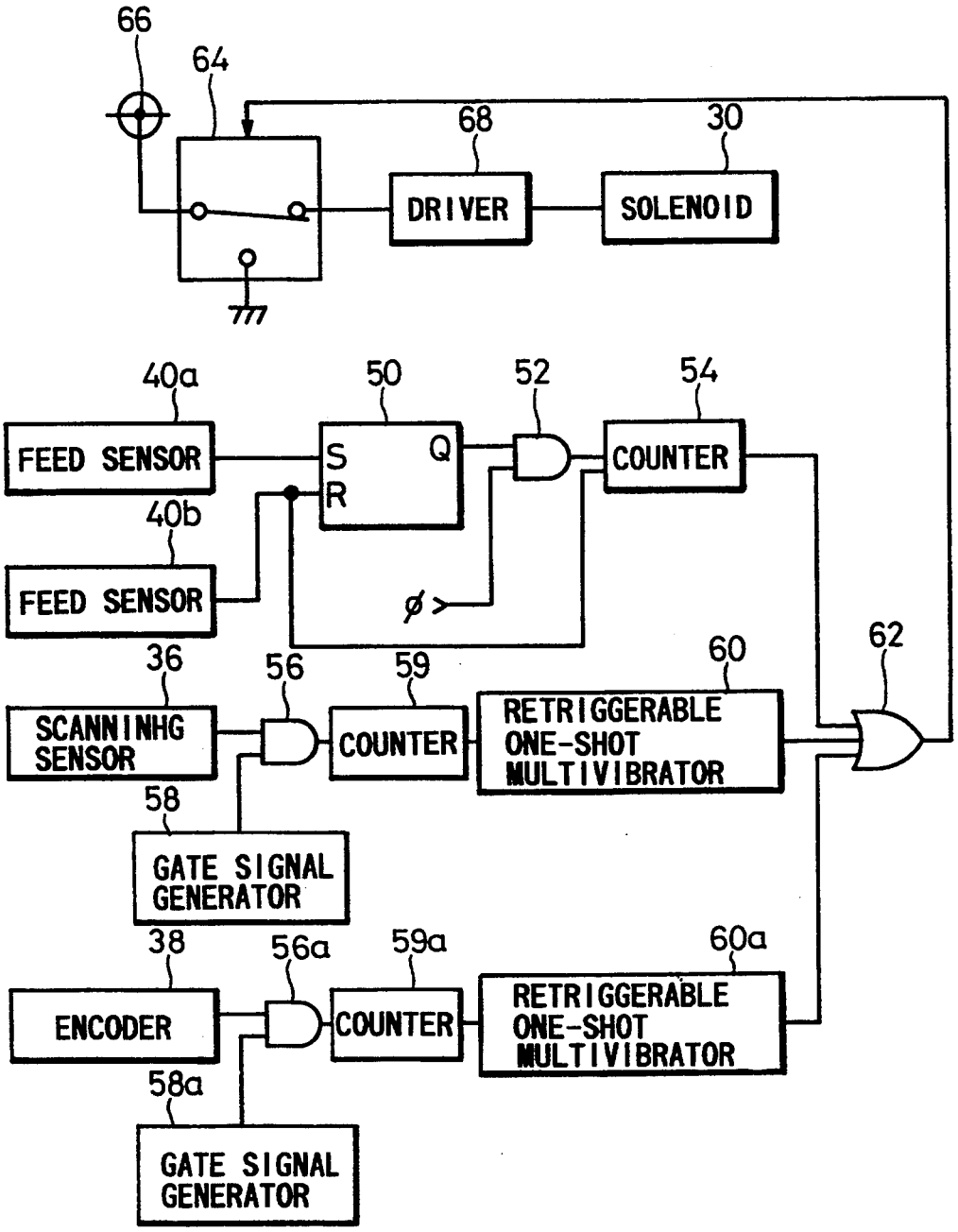
FIG. 2 is a fragmentary block diagram illustrating a logic circuit of the thermal recording apparatus shown in FIG. 1.

The operation of the thermal recording apparatus 10 constructed as described above will next be described below in accordance with a logic circuit (see FIG. 2) of the controller 42.

The feed roller 28 is first rotated by the motor 26 thereby to feed the thermo-sensitive recording medium S in the auxiliary scanning direction (i.e., in the direction indicated by the arrow B). If, at this time, a confirmation is made by the feed sensor 40*a* as to whether the leading end of the thermo-sensitive medium S has passed through the feed sensor 40*a*, then the controller 42 causes the driver 44 to drive the laser diode 12. The laser diode 12 generates a laser beam L modulated according to the tone or gradation of an image to be recorded on the thermo-sensitive recording medium S. The laser beam L becomes parallel light rays by the collimator lens 14 and thereafter introduced into the polygon mirror 20 through the cylindrical lens 16 and the reflection mirror 18. The polygon mirror 20 is being rotated at a high speed under the driving action of the controller 42. In this condition, the laser beam L reflected from a reflection surface of the polygon mirror 20 is introduced into the thermo-sensitive recording medium S through the f$\theta$ lens 22 and the cylindrical mirror 24. Further, the thermo-sensitive recording medium S, which is being fed for the auxiliary scanning in the direction indicated by the arrow B, is scanned with the laser beam L for the main scanning in the direction indicated by the arrow A. Thus, light-absorbing dyes in the recording medium layer of the thermo-sensitive recording medium S absorb the laser beam and convert it into the thermal energy. This thermal energy causes the microcapsules to melt so as to form the image having a desired tone.

Figure 3:
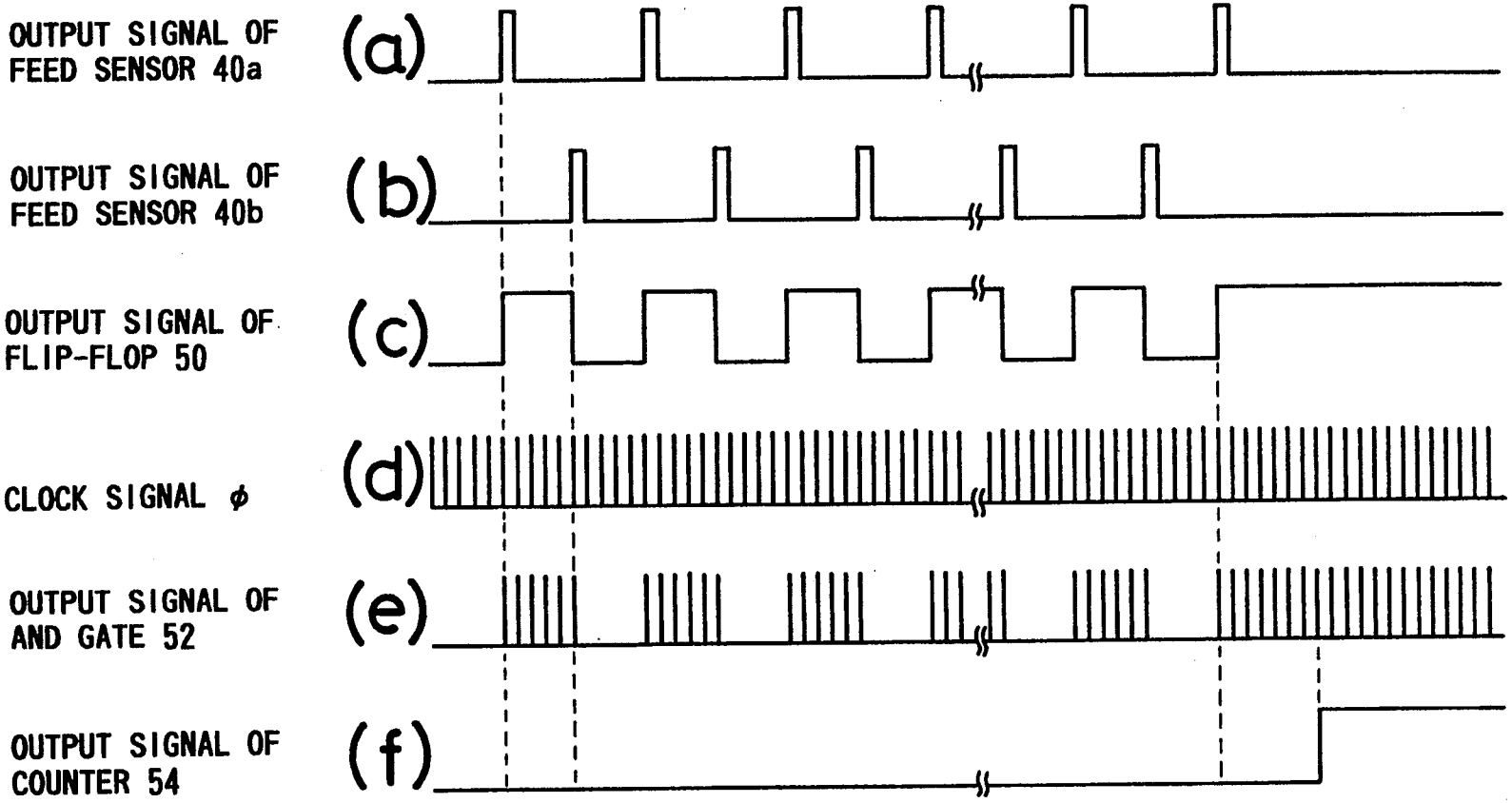
FIG. 3 is a timing chart for describing waveforms associated with outputs of carrier sensors employed in the thermal recording apparatus shown in FIG. 1.

In the thermal recording apparatus 10 which records the image on the thermo-sensitive recording medium S in this way, a signal indicative of the passage of the thermo-sensitive recording medium S, which is outputted from the feed sensor 40*a*, is supplied to a set terminal S of a flip-flop 50 of the controller 42 as a pulse signal (see (*a*) of FIG. 3). When the leading end of the thermo-sensitive recording medium S passes through the feed sensor 40*b*, the feed sensor 40*b* generates a passage signal (see (*b*) of FIG. 3) and supplies it to a reset terminal R of the flip-flop 50 of the controller 42. Thus, a pulse signal shown in (*c*) of FIG. 3 is inputted to an AND gate 52 from the output terminal Q of the flip-flop 50 based on the pulse signal transmitted to the controller 42. The so-input pulse signal is synchronized with a clock signal $\phi$ (see (d) of FIG. 3) in the AND gate 52. As a result, the AND gate 52 outputs a signal shown in (*e*) of FIG. 3 therefrom. The number of pulses in the output signal (see (*e*) of FIG. 3) is counted by a counter 54. In the present embodiment, the counter 54 is constructed so as to be reset in synchronism with the pulse signal produced from the feed sensor 40*b*. The counter 54 is set up so that it does not output a high level signal when the number of the pulses input to the counter 54 does not reach 8 or more, for example, before the counter 54 is reset (see (*f*) of FIG. 3). Thus, when the thermo-sensitive recording medium S is passed between the feed sensors 40*a* and 40*b* at a predetermined speed, the output of the counter 54 remains at a low level and a switch 64 is not activated by the output of an OR gate 62. Accordingly, the recording of an image on the thermo-sensitive recording medium S by the laser beam L is continuously effected.

When, on the other hand, the pulse signal is not supplied from the feed sensor 40*b* after the elapse of a predetermined time interval after the pulse signal outputted from the feed sensor 40*a* has been supplied to the flip-flop 50 of the controller 42, the signal (see (*c*) of FIG. 3) outputted from the flip-flop 50 remains at a high level. Accordingly, the counter 54 counts the number of the pulses based on the output signal produced from the AND gate 52. When the number of the pulses reaches 8 or more, the counter 54 generates an abnormal or malfunction signal. The malfunction signal is supplied to the switch 64 through the OR gate 62 so as to de-activate the switch 64. As a result, the solenoid 30, which has been normally activated by a driver 68, is de-activated to displace the shielding plate 32 of the blocking means 34 into the optical path of the laser beam L, thereby blocking the laser beam L from passing. Thus, when inconvenience such as jamming of the thermo-sensitive recording medium S on the feeding path is developed, the laser beam L is rapidly blocked by the blocking means 34 in the above-described manner. Therefore, the thermo-sensitive recording medium S can be prevented from being excessively heated.

Figure 4:
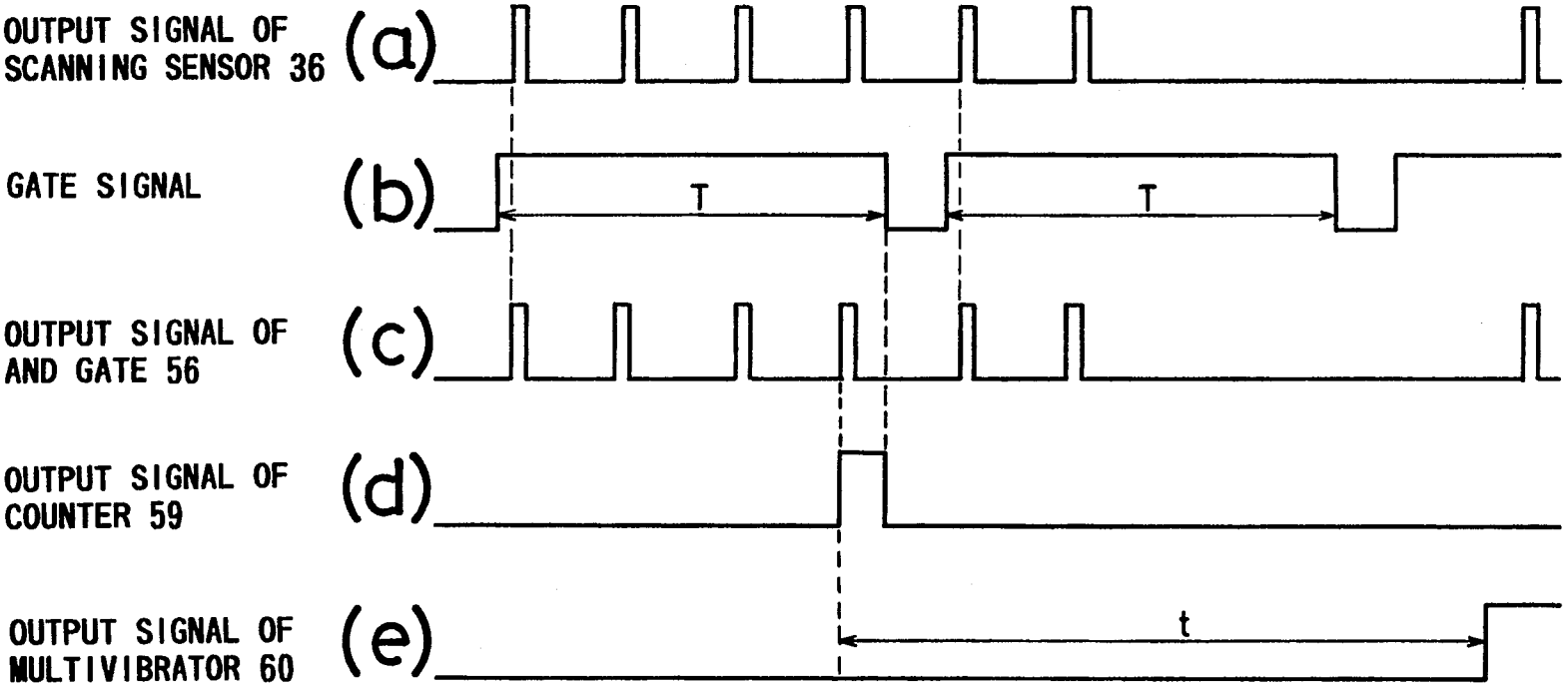
FIG. 4 is a timing chart for describing waveforms associated with the output of a scanning sensor employed in the thermal recording apparatus shown in FIG. 1.

Further, the scanning sensor 36 generates a pulse signal (see (*a*) of FIG. 4) each time the laser beam L deflected by the polygon mirror 20 passes through the scanning sensor 36, and supplies the pulse signal to an AND gate 56 of the controller 42. A gate signal generator 58 generates a gate signal (see (*b*) of FIG. 4) having an interval T. The AND gate 56 outputs the logical product or AND of the gate signal and the pulse signal therefrom (see (*c*) of FIG. 4). The number of pulses in the output signal of the AND gate 56 is counted by a counter 59. In the present embodiment, the counter 59 is constructed so as to be reset in synchronism with the fall of the gate signal produced by the gate signal generator 58, and output a high level signal when the number of the input pulses reaches 4 or more, for example, before the counter 59 is reset (see (*d*) of FIG. 4). The outputted signal is supplied to a retriggerable one-shot multivibrator (hereinafter abbreviated as "multivibrator") 60. When a new input signal is supplied from the counter 59 within a predetermined time interval t (see (*e*) of FIG. 4), a high-level signal is not outputted from the multivibrator 60. When, however, the rotational speed of the polygon mirror 20 is reduced owing to some causes, the number of the pulses per unit time, which are outputted from the AND gate 56 (scanning sensor 36), becoming less than a predetermined number (see (*c*) of FIG. 4), no input signal is supplied from the counter 59 to the multivibrator 60 during the predetermined time interval t, and the multivibrator 60 outputs a malfunction signal therefrom (see (*e*) of FIG. 4). Thus, the blocking means 34 is driven in response to the malfunction signal in a manner similar to the feed sensors 40*a* and 40*b* so as to block the laser beam L from traveling.

Incidentally, the encoder 38 mounted to the motor 26 is also constructed in the same manner as the scanning sensor 36 under the control of the controller 42. The same elements of structure as those employed in the scanning sensor 36 are identified by like reference numerals with a suffix a. Thus, when the number of pulses per unit time, which have been outputted from the encoder 38, becomes less than a predetermined number, a multivibrator 60*a* outputs an abnormal or malfunction signal therefrom. As a result, the blocking means 34 is activated in response to the malfunction signal so as to block the laser beam L from traveling.

Thus, when undesired states such as a jam of the thermo-sensitive recording medium S, etc. are detected by the feed sensors 40*a* and 40*b*, when a variation in the number of rotations of the motor 26 is detected, or when a trouble in the rotation of the polygon mirror 20 is detected, the blocking means 34 is driven under the control of the controller 42 to displace the shielding plate 32 to the position indicated by the broken line in FIG. 1, thereby blocking the laser beam L from traveling. In doing so, the thermo-sensitive recording medium S and the thermal recording apparatus 10 can be prevented from being excessively heated owing to a failure in feeding of the thermo-sensitive recording medium S and a failure in operation of the thermal recording apparatus 10. Thus, safety of the thermal recording apparatus 10 can also be assured.

Incidentally, the present embodiment shows a case in which the shielding plate 32 is displaced based on the malfunction signal so as to block the laser beam L from traveling. It is however needless to say that the emission of the laser beam L from the laser diode 12 may be stopped by stopping the supply of a signal from the controller 42 to the driver 44.

Further, the above-described embodiment shows the apparatus in which the auxiliary scanning is effected by the feeding or conveying the thermo-sensitive recording medium. However, a main scanning unit may be displaced with respect to the thermo-sensitive recording medium so as to effect an auxiliary scanning process. It is also needless to say that the present invention can be applied even to a so-called drum-scanner type apparatus in which a thermo-sensitive recording medium is wound on a rotary drum, a main scanning process is effected under the rotation of the drum and a laser beam is moved in the direction of a rotatable shaft of the drum so as to effect an auxiliary scanning process.

Having now fully described the invention, it will be apparent to those skilled in the art that many changes and modification can be made without departing from the spirit or scope of the invention as set forth herein.

What is claimed is:

1. A thermal recording apparatus for recording an image on a thermo-sensitive recording medium having leuco dyes, a developer and light-absorbing dyes, all provided on a support member, by irradiating the thermo-sensitive recording medium with a laser beam so as to apply predetermined heat energy thereto, moving the laser beam in a direction so as to effect main scanning, moving said thermo-sensitive recording medium in a direction substantially perpendicular to a main scanning direction so as to effect auxiliary scanning, said thermal recording apparatus comprising:

main-scanned state detecting means for detecting the state of the main scanning effected on said laser beam;

auxiliary-scanned state detecting means for detecting the state of the auxiliary scanning effected on said thermo-sensitive recording medium for feeding the same;

determining means for determining an abnormality in the operation of said thermal recording apparatus based on detection signals produced by said main scanned state detecting means and said auxiliary scanned state detecting means; and blocking means for preventing said thermo-sensitive recording medium from being kept irradiated with said laser beam when the operation of said thermal recording apparatus is determined as being in the abnormality.

2. A thermal recording apparatus according to claim 1, wherein said blocking means comprises shielding means movable to and away from the optical path of said laser beam.

* * * * *